US011512675B2

(12) United States Patent
Molz

(10) Patent No.: US 11,512,675 B2
(45) Date of Patent: Nov. 29, 2022

(54) STARTER MOUNTING

(71) Applicant: DEUTZ Aktiengesellschaft, Cologne (DE)

(72) Inventor: Achim Molz, Wesseling (DE)

(73) Assignee: Deutz Aktiengesellschaft, Cologne (DE)

( * ) Notice: Subject to any disclaimer, the term of this patent is extended or adjusted under 35 U.S.C. 154(b) by 0 days.

(21) Appl. No.: 17/474,880

(22) Filed: Sep. 14, 2021

(65) Prior Publication Data

US 2022/0090572 A1 Mar. 24, 2022

(30) Foreign Application Priority Data

Sep. 18, 2020 (DE) ..... 102020005721.7

(51) Int. Cl.
*F02N 15/00* (2006.01)

(52) U.S. Cl.
CPC ..... *F02N 15/006* (2013.01)

(58) Field of Classification Search
CPC ..... F02N 16/006
USPC ..... 123/179.25
See application file for complete search history.

(56) References Cited

U.S. PATENT DOCUMENTS 1,905,836 A * 4/1933 Fitz Gerald ..... F02N 15/04 74/7 R
2,074,110 A * 3/1937 Gruenberger ..... F02N 15/063 74/7 R
2,760,377 A 8/1956 Critchfield et al.
3,536,051 A 10/1970 Hamman et al.
3,598,093 A * 8/1971 Tanaka ..... F02N 15/006 123/41.31
4,155,266 A * 5/1979 Bradley ..... F02N 15/006 123/179.25
4,336,975 A * 6/1982 Casteel ..... H01R 11/32 439/503
5,207,195 A * 5/1993 McClintic ..... F01M 11/03 123/179.25
7,314,111 B2 * 1/2008 Matsumoto ..... F02B 75/22 180/292
9,121,382 B2 * 9/2015 Yamada ..... F02N 11/087
2010/0050976 A1 * 3/2010 Taki ..... F02F 7/0058 123/195 C
2011/0088649 A1 4/2011 Minneker, Jr. et al.
(Continued)

FOREIGN PATENT DOCUMENTS

CN 102042390 A 5/2011
CN 108884760 A 11/2018
(Continued)

*Primary Examiner* — Phutthiwat Wongwian
*Assistant Examiner* — Arnold Castro
(74) *Attorney, Agent, or Firm* — Davidson, Davidson & Kappel, LLC

(57) ABSTRACT

An internal combustion engine is described, including at least one starter (1) having a starter transmission that is situated at the opposite end of the crankshaft or at the same end to transfer the rotation of the starter (1) to the crankshaft, the starter (1) being situated at the crankcase (4) of the internal combustion engine and the starter (1) being inserted into a receiving hole (7) and being situated in a fastenable manner at the crankcase (4) with the aid of at least one screw (2), and a holder (5) being situated at the starter (1).

19 Claims, 3 Drawing Sheets

(56) References Cited

U.S. PATENT DOCUMENTS

| | | | | |
|---|---|---|---|---|
| 2012/0073527 | A1* | 3/2012 | Oltmans | F01P 5/12 123/41.47 |
| 2015/0101576 | A1* | 4/2015 | Shiraishi | F02B 61/02 123/509 |
| 2015/0102692 | A1* | 4/2015 | Bae | H02K 11/00 310/71 |
| 2019/0085788 | A1 | 3/2019 | Kashiwa et al. | |

FOREIGN PATENT DOCUMENTS

| | | | |
|---|---|---|---|
| CN | 111441890 | A | 7/2020 |
| DE | 102006021239 | A1 | 11/2007 |

* cited by examiner

STARTER MOUNTING

This claims the benefit of German Patent Application DE 10 2020 004 046.2, filed Sep. 18, 2020 and hereby incorporated by reference herein.

DESCRIPTION

The present invention relates to an internal combustion engine including a universal retention system at an electric starter, in particular for laying a cable harness.

BACKGROUND

Starter devices are known, in which the starter is screwed at a flange surface at a perpendicular orientation with regard to the starter axis. The fastening screws are screwed axially with regard to the starter axis in this case. Cable harness fastening systems are further known that are implemented via buttons at the crankcase of the internal combustion engine downstream from the starter with the aid of individual sheet metal holders.

This is disadvantageous, since additional buttons are required that would actually not be necessary.

SUMMARY OF THE INVENTION

It is an object of the present invention to avoid the above-named disadvantages.

The present invention provides an internal combustion engine, including at least one starter having a starter transmission that is situated at the opposite end of the crankshaft or at the same end to transfer the rotation of the starter to the crankshaft, the starter being situated at the crankcase of the internal combustion engine and the starter being inserted into a receiving hole and being situated in a fastenable manner at the crankcase with the aid of at least one screw and a holder being situated at the starter. The advantage here is that the accessibility of the fastening screws is considerably improved, while unnecessary material buildups at the crankcase are dispensed with at the same time.

A further refinement according to the present invention provides that at least one support plate is situated at the end of the starter. The advantage here is that in longer starters, in particular, the oscillation tendency is reduced or prevented.

The subclaims contain further advantageous refinements.

BRIEF DESCRIPTION OF THE DRAWINGS

The present invention is described in greater detail on the basis of exemplary embodiments with reference to the appended drawings.

DETAILED DESCRIPTION

Figure 1A:
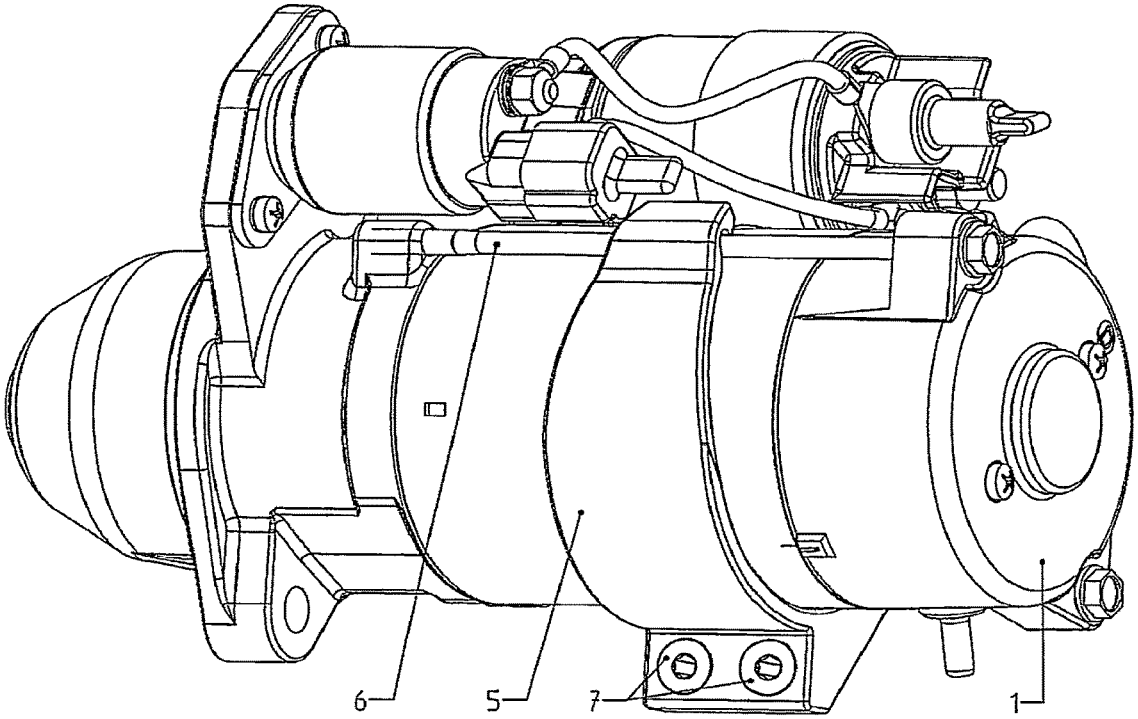
FIGS. 1*a* and 1*b* show different views of a starter system including a holder.
Figure 1B:
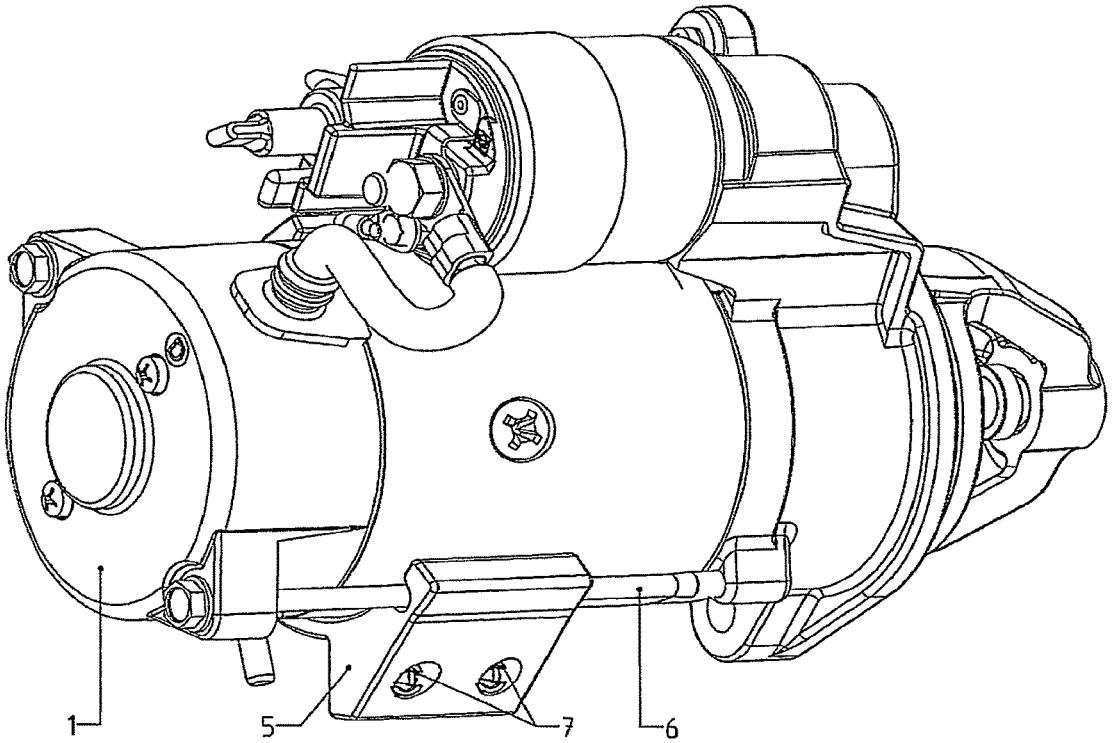

FIGS. 1*a* and 1*b* show different views of a starter 1 that is detachably connectable to a crankcase 4 (FIG. 4) with the aid of two screws 2 (FIG. 4) and includes a holder 5 that is fastened to two guide bars 6 and includes a locking pin 8 that engages with a corresponding indentation of the starter outer skin, so that the holder is situated at starter 1 in a non-displaceable manner. Holder 5 includes two receiving holes 7, into which a support plate 3 (FIG. 4) may be screwed by screws 13 that is suitable for receiving cable harnesses 9 (FIG. 4) and/or fluid pipes 10 (FIG. 4).

Figure 2A:
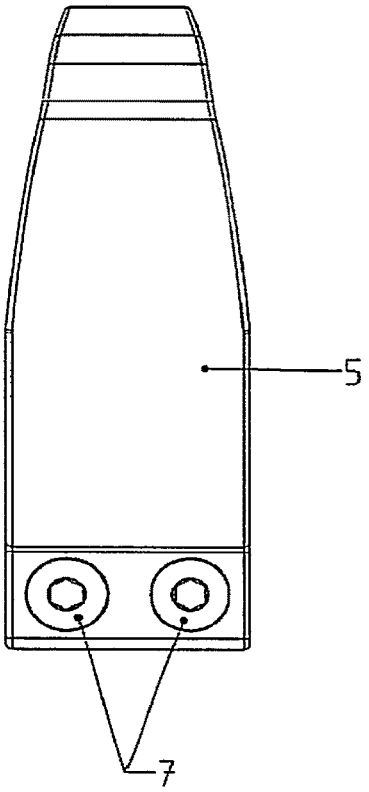
FIGS. 2*a* and 2*b* show front and back views of holder shown in FIGS. 1*a* and 1*b* including a locking pin and a receiving hole.
Figure 2B:
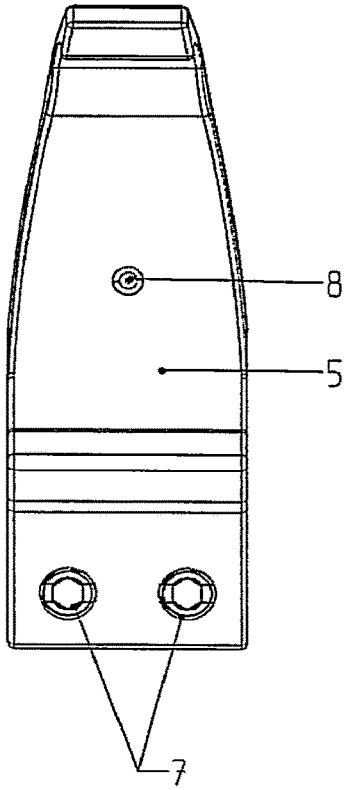

FIGS. 2*a* and 2*b* show front and back views of holder 5 shown in FIG. 1 having locking pin 8 and receiving holes 7. Holder 5 is fastened to two guide bars 6 and includes locking pin 8 that engages with a corresponding indentation of the starter outer skin, so that the holder is situated at starter 1 in a non-displaceable manner. Holder 5 includes two receiving holes 7, into which support plate 3 may be screwed by screws 13 that is suitable for receiving cable harnesses 9 (FIG. 4) and/or fluid pipes 10 (FIG. 4).

Figure 3A:
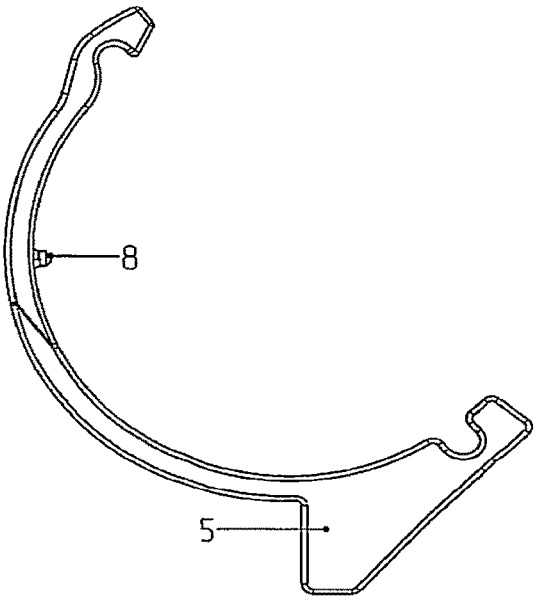
FIGS. 3*a* and 3*b* show different side views of the holder from FIG. 1.
Figure 3B:
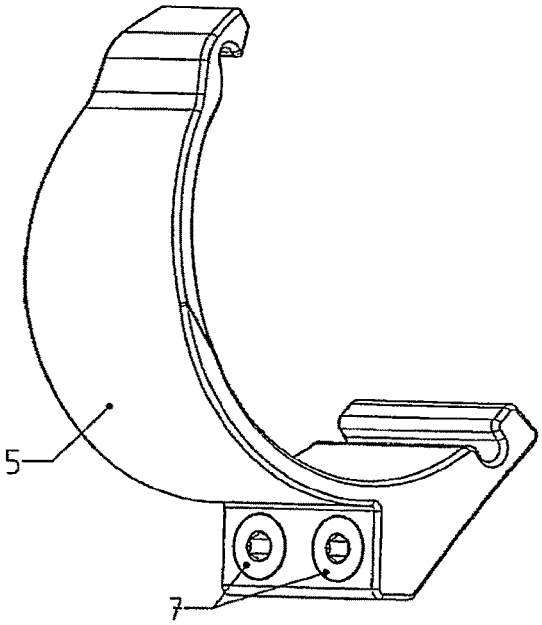

FIGS. 3*a* and 3*b* show different side views of holder 5 from FIG. 1. Holder 5 is mounted at two guide bars 6 with the aid of the mounting contour for fastening to starter 1 and includes locking pin 8 that engages with a corresponding indentation of the starter outer skin, so that the holder is situated at starter 1 in a non-displaceable manner. Holder 5 includes two receiving holes 7, into which support plate 3 may be screwed by screws 13 that is suitable for receiving cable harnesses 9 (FIG. 4) and/or fluid pipes 10 (FIG. 4).

Figure 4:
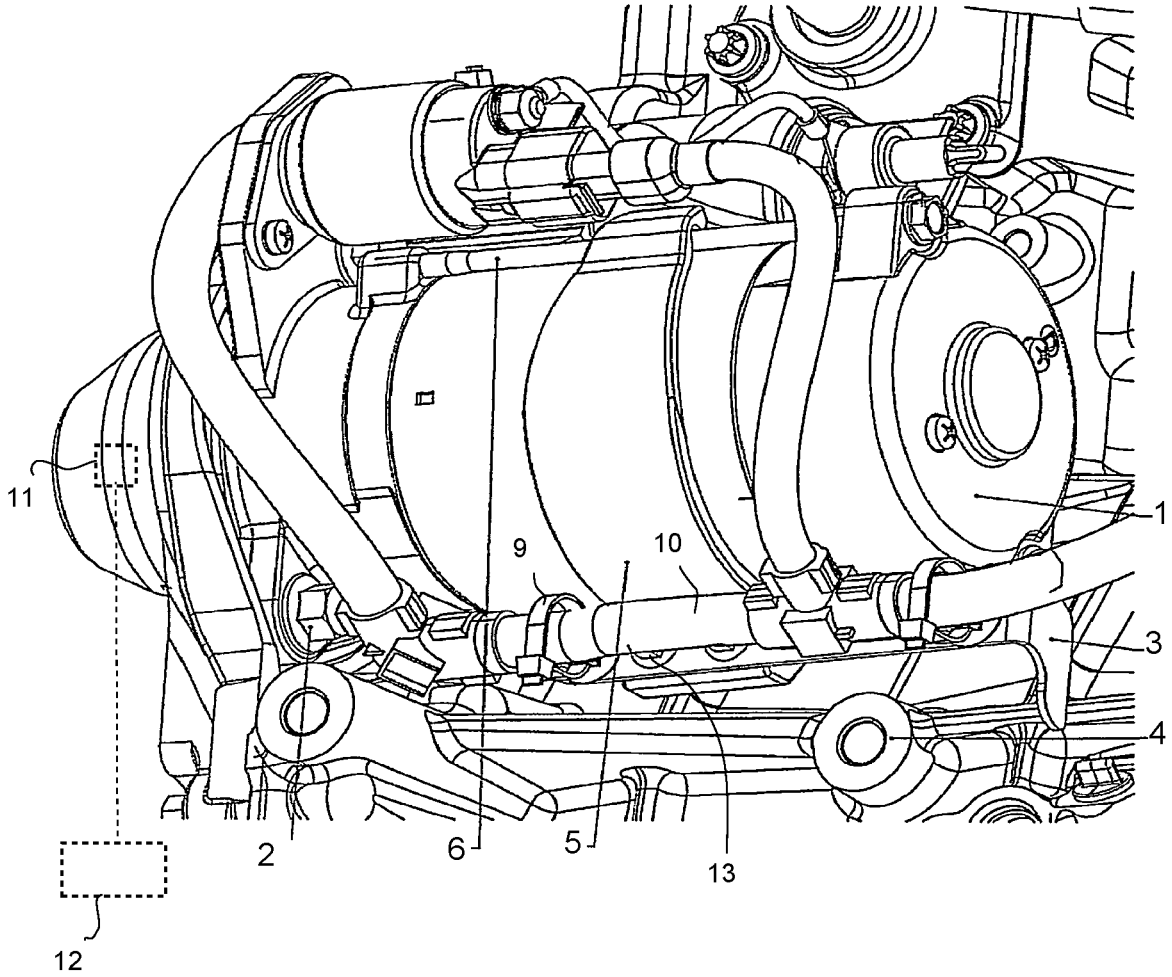
FIG. 4 shows a starter including a holder, a support plate, and a cable harness situated at the support plate.

FIG. 4 shows starter 1 including holder 5, support plate 3, and a cable harness situated at the support plate. Holder 5 is mounted at two guide bars 6 with the aid of the mounting contour for fastening to starter 1 and includes locking pin 8 (FIG. 2) that engages with a corresponding indentation of the starter outer skin, so that the holder is situated at starter 1 in a non-displaceable manner. Holder 5 includes two receiving holes 7, into which support plate 3 may be screwed by screws 13 that is suitable for receiving cable harnesses 9 (FIG. 4) and/or fluid pipes 10 (FIG. 4). Starter 1 has a starter transmission 11 that is situated at the opposite end of the crankshaft 12 or at the same end to transfer the rotation of the starter 1 to the crankshaft 12.

To reduce potentially occurring oscillations of the free end of the starter, an additional support plate may be situated at the end of the starter.

LIST OF REFERENCE NUMERALS

1 starter
2 screw
3 support plate
4 crankcase
5 holder
6 guide bars
7 receiving hole
8 locking pin
9 cable harness
10 fluid pipe
11 starter transmission
12 crankshaft
13 screws

What is claimed is:

1. An internal combustion engine comprising:

a crankcase;

a crankshaft;

a starter having a starter transmission configured for transferring rotation of the starter to the crankshaft, the starter being situated at the crankcase, the starter being inserted into a receiving hole and being situated in a fastenable manner at the crankcase by at least one screw, the starter extending longitudinally in a longitudinal direction; and a holder being situated at the starter, wherein the holder is fastened at the starter by guide bars extending in the longitudinal direction through the holder.

2. The internal combustion engine as recited in claim 1, wherein the holder at the starter is made of plastic.

3. The internal combustion engine as recited in claim 1, wherein the holder includes at least one receiving hole.

4. The internal combustion engine as recited in claim 1, wherein the starter is connected to the internal combustion engine by at least two screws.

5. The internal combustion engine as recited in claim 1, wherein at least one support plate is situated at an end of the starter.

6. The internal combustion engine as recited in claim 1, wherein the holder includes at least one receiving hole, in which a support plate is mounted, the support plate configured for receiving cables or pipes.

7. The internal combustion engine as recited in claim 1, wherein the guide bars hold further screws of the starter.

8. The internal combustion engine as recited in claim 1 wherein the guide bars include a first guide bar connected to the starter and extending in the longitudinal direction through a first end of the holder and a second guide bar circumferentially offset from the first guide bar connected to the starter and extending in the longitudinal direction through a second end of the holder.

9. The internal combustion engine as recited in claim 8, wherein the holder has a semi-cylindrical inner surface, a first groove and second groove, the first groove recessed into semi-cylindrical inner surface and extending in the longitudinal direction, the second groove recessed into semi-cylindrical inner surface and extending in the longitudinal direction, the first guide bar being received in the first groove and the second guide bar being received in the second groove.

10. The internal combustion engine as recited in claim 8, wherein the holder has two fastener receiving holes positioned circumferentially between the first end and the second end of the holder.

11. The internal combustion engine as recited in claim 10, further comprising a support plate and fasteners passing through the support plate and the receiving holes to fix the support plate to the holder.

12. The internal combustion engine as recited in claim 11, wherein the support plate is configured for receiving cable harnesses and/or fluid pipes.

13. An internal combustion engine comprising:

a crankcase;

a crankshaft;

a starter having a starter transmission configured for transferring rotation of the starter to the crankshaft, the starter being situated at the crankcase, the starter being inserted into a receiving hole and being situated in a fastenable manner at the crankcase by at least one screw; and a holder being situated at the starter, wherein the holder includes a locking pin that engages with a corresponding indentation in the outer surface of the starter.

14. An internal combustion engine comprising:

a crankcase;

a crankshaft;

a starter having a starter transmission configured for transferring rotation of the starter to the crankshaft, the starter being fixed on the crankcase;

a holder for securing at least one cable harness and/or fluid pipes to the starter, the holder wrapped around a portion of an outer surface of the starter; and a support plate fixed to an outer surface of the holder for securing at least one cable harness and/or fluid pipes to the starter.

15. The internal combustion engine as recited in claim 14, wherein the holder has a semi-cylindrical inner surface.

16. The internal combustion engine as recited in claim 15, wherein the starter extends longitudinally in a longitudinal direction, the internal combustion engine further comprising a first guide bar connected to the starter and extending in the longitudinal direction through a first end of the holder and a second guide bar circumferentially offset from the first guide bar connected to the starter and extending in the longitudinal direction through a second end of the holder, the semi-cylindrical inner surface extending between the first end and the second end.

17. The internal combustion engine as recited in claim 15, wherein the holder has a protrusion on the semi-cylindrical inner surface for fixing the holder axially in place on the starter.

18. The internal combustion engine as recited in claim 14, further comprising a support plate fixed to an outer surface of the holder for securing at least one cable harness and fluid pipes to the starter.

19. The internal combustion engine as recited in claim 14, further comprising at least one fastener extending through the support plate and into at least one hole.

* * * * *